US007160081B2

(12) United States Patent
Rival

(10) Patent No.: US 7,160,081 B2
(45) Date of Patent: Jan. 9, 2007

(54) VACUUM PUMP

(75) Inventor: Jean-Luc Rival, Villaz (FR)

(73) Assignee: Alcatel, Paris (FR)

( * ) Notice: Subject to any disclaimer, the term of this patent is extended or adjusted under 35 U.S.C. 154(b) by 94 days.

(21) Appl. No.: 10/919,447

(22) Filed: Aug. 17, 2004

(65) Prior Publication Data

US 2005/0047904 A1 Mar. 3, 2005

(30) Foreign Application Priority Data

Aug. 29, 2003 (FR) ..... 03 10282

(51) Int. Cl.
*F04D 19/04* (2006.01)

(52) U.S. Cl. ..... 415/199.6; 415/116; 415/111; 415/229

(58) Field of Classification Search ..... 415/90, 415/116, 131, 229, 199.1, 199.5, 111, 199.6; 416/126, 175, 198 A, 203; 417/423.4, 423.8
See application file for complete search history.

(56) References Cited

U.S. PATENT DOCUMENTS 6,135,709 A * 10/2000 Stones ..... 415/90
6,606,536 B1 * 8/2003 Aso ..... 700/174
6,672,827 B1 * 1/2004 Yamashita et al. ..... 415/90
6,779,969 B1 * 8/2004 Nonaka et al. ..... 415/90

FOREIGN PATENT DOCUMENTS

EP 0 959 253 A2 11/1999
EP 1 201 929 A2 5/2002
EP 1 318 309 A2 6/2003

* cited by examiner

*Primary Examiner*—Ninh H. Nguyen
(74) *Attorney, Agent, or Firm*—Sughrue Mion, PLLC

(57) ABSTRACT

A vacuum pump of the invention comprises, in a common pump body (100): molecular drag pump stages (5) in series with regenerative pump stages (9). The molecular drag pump stages (5) comprise a molecular drag rotor (5*a*) including a blind axial cavity (5*c*) open towards the downstream end, and the motor (7) is housed at least in part in said blind axial cavity (5*c*). The drive shaft (8) is coupled via its upstream end (8*a*) to the molecular drag rotor (5*a*), and it is coupled via its downstream portion (8*b*) to the regenerative rotor (9*a*). The motor (7) is secured to the central segment of the drive shaft (8). This provides a universal pump of small size, enabling pumping to be performed from 1000 mbar down to $10^{-8}$ mbar, and suitable for being placed in the vicinity of a vacuum chamber.

22 Claims, 5 Drawing Sheets

VACUUM PUMP

The present invention relates to vacuum pumps enabling a suitable vacuum to be generated and maintained in a vacuum enclosure or in a vacuum line.

Various types of vacuum pump are known, each of which is generally adapted to particular conditions of flow rate and pressure of the pumped gas.

Thus, primary pumps have been devised which deliver to atmospheric pressure, which have a plurality of compression stages, and which have last stages that produce a large amount of compression under a relatively low volume flow rate. An example of such a primary pump is a regenerative pump formed by a disk-shaped rotor with concentric ribs fitted with individual radial blades engaged in corresponding intercommunicating concentric angular grooves of the stator.

Primary pumps made in that way cannot achieve vacuums that are sufficiently high for numerous vacuum applications. They are therefore associated in series with at least one secondary pump, for example a pump of the molecular drag type or of the turbomolecular type, with the delivery of the secondary pump being connected in gas-flow connection with the intake of the primary pump.

A molecular drag or turbomolecular pump must be capable of being placed in the immediate vicinity of the vacuum enclosure that it is to evacuate, in order to benefit from a maximum pumping speed in the vacuum enclosure.

Unfortunately, the size and the weight of the single-axis primary pump stage is usually incompatible with it being closely integrated with the vacuum enclosure, and consequently the primary pump must be spaced apart from the vacuum chamber, and pumping performance is thus degraded.

Proposals have already been made to couple the primary pump and the secondary pump together mechanically so that they are driven by a common motor on a common drive shaft. Thus, a pump has already been described in document U.S. Pat. No. 5,848,873 or in document U.S. Pat. No. 6,135,709, that is composite, in which a regenerative pump stage having radial blades engaged in annular grooves of the stator is mounted on the same rotor as a molecular drag pump stage, and possibly a turbomolecular pump stage, the pump stages being in a gas-flow series connection, the rotors being mounted one after another on the same drive shaft having one end coupled to a drive motor. The regenerative pumping stage presents the advantage of performing the primary pump function, delivering to atmospheric pressure, while also having a speed of rotation that is high and compatible with the speeds of rotation that are usable for molecular drag or turbomolecular stages.

The motor of such a composite pump must be capable of delivering significant power to drive the primary pump. The position of the motor at the end of the drive shaft leads to bulk that prevents the composite pump being integrated in the immediate vicinity of the vacuum enclosure that the pump is to evacuate.

The solutions proposed in document U.S. Pat. No. 5,848,873 and U.S. Pat. No. 6,135,709 are therefore not sufficient for vacuum applications in which it is desired to integrate the pumping system directly in the vicinity of the vacuum enclosure.

The problem on which the present invention is based is to devise a novel structure for a composite pump which is sufficiently compact to enable it to be integrated in the immediate vicinity of vacuum enclosures or process chambers, and which is capable of pumping from atmospheric pressure (1000 mbar) down to the high vacuums that are usually needed in certain industries ($10^{-8}$ mbar).

For that purpose, the invention is based on the idea both of reducing the size of the motor that drives the pump, and of placing the motor inside the pump so as to further reduce the overall size of the motor and pump unit.

In another aspect of the invention, a pump structure is provided having a primary stage which presents pumping properties that are improved and adjustable, so as to enable satisfactory pumping to be performed using a pump of smaller volume.

To achieve these objects, amongst others, the vacuum pump of the invention comprises, in a common pump body, at least one molecular drag pump stage in series in air-flow connection with at least one primary pump stage of compatible speed, the molecular drag pump stage having a molecular drag rotor co-operating with a molecular drag stator provided in the pump body, the primary pump stage having a primary rotor co-operating with a primary stator provided in the pump body, the molecular drag rotor and the primary rotor being rotated by a common drive shaft coupled to a motor. According to the invention:

- the molecular drag rotor includes a blind axial cavity that is open towards the downstream end of the pump body;
- the motor is housed at least in part in said blind axial cavity of the molecular drag rotor;
- the drive shaft is coupled via its upstream end to the molecular drag rotor; and
- the drive shaft is coupled via its downstream portion to the primary rotor.

The primary pump stage of compatible speed is a viscous drag mechanical pump structure comprising a stator and a rotor, enabling delivery to take place at atmospheric pressure, and operating properly at the speeds of rotation that are usual for molecular drag or turbomolecular stages, i.e. speeds of about 20,000 revolutions per minute (rpm).

In a practical embodiment, the drive shaft is carried to rotate by an upstream bearing and a downstream bearing, the upstream bearing being situated between the motor and the zone for coupling to the molecular drag rotor, the downstream bearing being situated between the motor and the zone for coupling to the primary rotor.

In a first embodiment, a composite vacuum pump of the invention is such that:

- the primary rotor is a multistage regenerative rotor using viscous drag, comprising a disk having a transverse face carrying a series of concentric annular ribs each carrying individual radial blades;
- the primary stator is a regenerative stator including a corresponding transverse face having a series of concentric annular grooves in which the individual radial blades of the regenerative rotor are engaged;
- the concentric annular grooves of the regenerative stator are of cross-section that is greater than the cross-section of the corresponding individual radial blades of the regenerative rotor, with the exception of a short groove zone of small section in which the individual radial blades engaged with little clearance; and
- the successive concentric annular grooves are connected to one another via respective communication channel provided at the downstream end of the corresponding small section groove zone.

The small section zones of the groove serve to establish a barrier against leaks between two distinct annular grooves, which are at different pressures.

In a second embodiment, a vacuum pump of the invention is such that the primary rotor is a multistage regenerative rotor using viscous drag comprising one or more disks, each having a transverse face carrying oblique centrifugal ribs which co-operate with a corresponding transverse face of a multistage regenerative stator.

An improvement consists in providing for the primary pump stage to be such that the primary rotor has an upstream transverse face with oblique centrifugal ribs which co-operate with a corresponding transverse face of the pump body to constitute an additional regenerative pump stage. Thus, without increasing the size of the pump, a pump stage is added that enables pump performance to be improved.

Alternatively, in another variant, the primary pump stage is also such that:

- the oblique centrifugal ribs of the rotor co-operate with the corresponding transverse face of the pump body to constitute a downstream dynamic seal which produces suction protecting the downstream bearing;
- a last molecular drag stage is reversed to constitute an upstream dynamic seal which produces suction protecting the upstream bearing; and
- an inert gas inlet is adapted to deliver a flow of inert gas into the housing containing the motor, thereby producing a flow of inert gas through the bearings.

Preferably, in the above embodiments, the composite vacuum pump of the invention comprises a plurality of molecular drag pump stages constituted by rotor elements in the form of concentric cylinders connected to the drive shaft at their upstream ends, and a plurality of stator elements in the form of concentric cylinders having helical ribs and connected to the pump body at their downstream end, and engaged between successive concentric rotor cylinders.

Also, in order to increase pumping performance, provision can be made for the pump of the invention to comprise at least one turbomolecular pump stage in gas-flow connection upstream from the molecular drag pump stage(s), the turbomolecular pump stage comprising a turbomolecular rotor having at least one stage with radial fins and a turbomolecular stator having at least one annular groove in which the radial fins of the turbomolecular rotor are engaged.

Preferably, there are also provided a plurality of turbomolecular stages constituted by a rotor having a plurality of stages of radial fins distributed along the drive shaft and a plurality of corresponding annular grooves distributed along the stator.

In the above-defined embodiments, the internal position of the motor preferably leads to providing means that enable the overall efficiency of the motor to be increased, in order to reduce losses and thus heating of the motor in operation. The object is to provide the mechanical power needed for driving the pump, using a motor that is smaller. To do that, it is possible in particular to provide cooling means received in the stator of the motor, e.g. ducts through which a cooling liquid is caused to flow.

Preferably, provision is also made for:

- the motor to be adapted for a high speed of rotation, greater than 20,000 rpm in nominal operating conditions; and
- the concentric annular grooves and the corresponding individual radial blades to have a size that is smaller in the vicinity of the delivery from the regenerative pump stage.

In the invention, it is advantageous to provide a primary stator of the multistage regenerative type mounted to be movable in the axial direction relative to the pump body, and driven by displacement means enabling its axial position to be modified relative to the primary rotor, so that the pumping performance is adjustable. It should be observed that this disposition can be used in a regenerative stage pump independently of the presence or the absence of other characteristics as defined above, and that it thus constitutes an independent invention.

Furthermore, the drive shaft may advantageously be guided in rotation by magnetic bearings which enable lifetime to be increased and vibration to be decreased.

Other objects, characteristics, and advantages of the present invention stem from the following description of particular embodiments, given with reference to the accompanying figures, in which.

Figure 1:
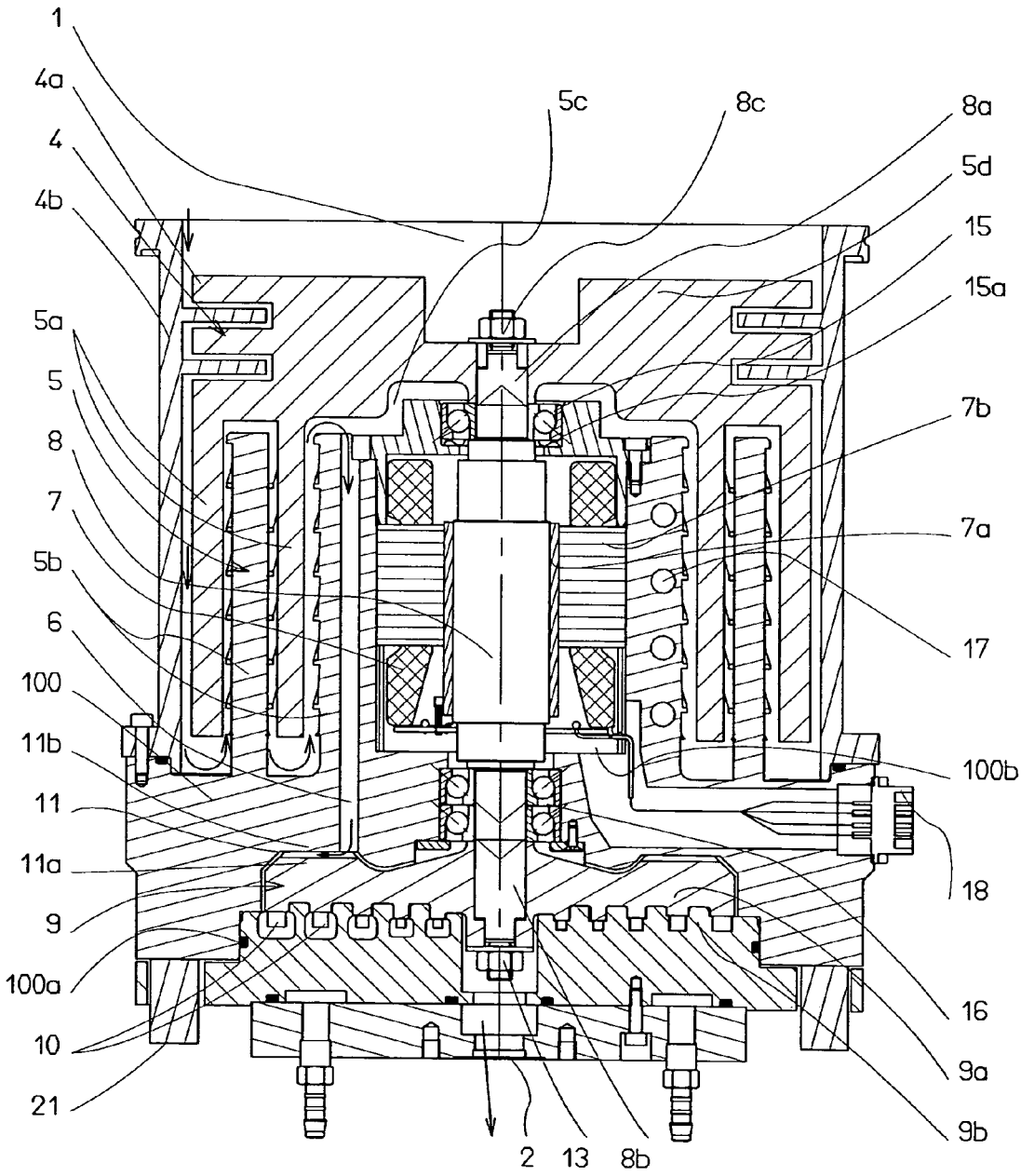
FIG. 1 is a diagrammatic longitudinal section view of a composite vacuum pump structure constituting a first embodiment of the present invention.

In the embodiment shown in FIG. 1, a composite vacuum pump of the invention comprises in a common pump body 100 having a suction orifice 1 and a delivery orifice 2, at least one molecular drag pump stage 5 connected in gas-flow connection via a transfer duct 6 in series with at least one primary pump stage 9 of multistage viscous drag regenerative type.

In the embodiment shown, the pump further comprises at least one turbomolecular pump stage 4 connected in air-flow connection upstream from the stage(s) of the molecular drag pump 5.

The molecular drag pump stage 5 comprises a molecular drag rotor 5*a* which co-operates with a molecular drag stator 5*b* provided in the pump body 100.

The primary pump stage 9 comprises a primary rotor 9*a* of regenerative type co-operating with a primary stator 9*b* of regenerative type provided in the pump body 100.

The molecular drag rotor 5*a* and the primary rotor 9*a* are rotated by a common drive shaft 8 coupled to an electric motor 7.

The motor 7 comprises a motor rotor 7*a* secured to the central segment of the drive shaft 8, turning in a motor stator 7*b*, itself fastened in a housing 100*b* of the pump body 100.

The drive shaft 8 is carried to rotate by an upstream bearing 15 and a downstream bearing 16, at opposite ends of the motor rotor 7*a*. In the embodiment shown in FIG. 1, the bearings 15 and 16 are mechanical bearings, and specifically ball bearings. Alternatively, it may be advantageous to provide for the bearings 15 and/or 16 to be magnetic bearings, in conventional manner.

The molecular drag rotor 5*a* has a blind axial cavity 5*c* that is open towards the downstream end of the pump body 100, i.e. it is open towards the delivery orifice 2, and it is closed towards the upstream end, i.e. towards the suction orifice 1, by a transverse wall 5*d*.

According to the invention, the motor 7 is received at least in part in said blind axial cavity 5*c* of the molecular drag rotor 5*a*. Preferably, as shown in FIG. 1, the motor 7 is housed entirely in the blind axial cavity 5*c* of the molecular drag rotor 5*a*. To do this, the drive shaft 8 is coupled via its upstream end 8*a* to the molecular drag rotor 5*a*, and the drive shaft 8 is coupled via its downstream portion 8*b* to the primary rotor 9*a*.

In the example shown, the upstream end 8*a* of the drive shaft 8 passes through an axial hole provided in the transverse wall 5*d* of the molecular drag rotor 5*a*, and it is fastened thereto by a nut 8*c*. In similar manner, the downstream portion 8*b* of the drive shaft 8 passes through a hole formed in the primary rotor 9*a*, and is fastened thereto by a nut 13.

In the embodiment shown, the upstream bearing 15 includes a resilient washer 15*a* for pre-loading the ball bearing that constitutes said upstream bearing 15.

The upstream bearing 15 is situated between the motor 7 and the upstream end 8*a* of the drive shaft 8, or the zone for coupling to the molecular drag rotor 5*a*.

The downstream bearing 16 is situated between the motor 7 and the downstream portion 8*b* of the drive shaft 8, or the coupling zone to the primary rotor 9*a*.

Figure 2:
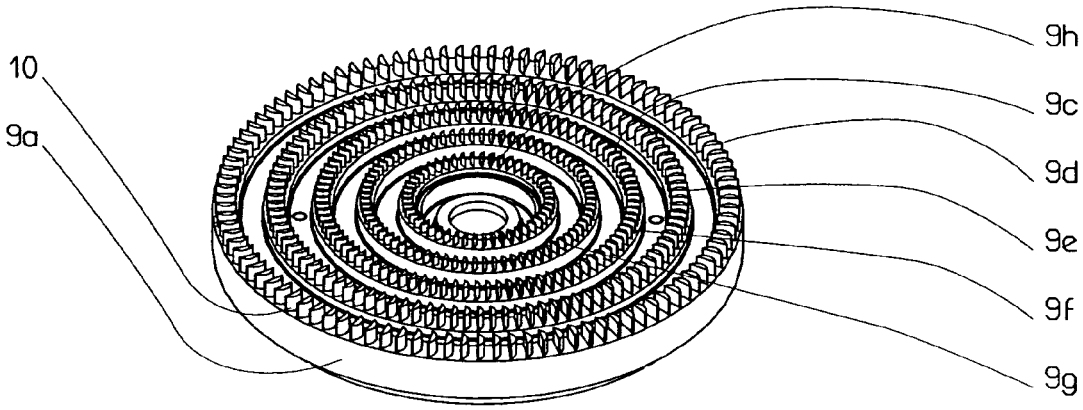
FIG. 2 shows the main downstream transverse face of the regenerative rotor of the FIG. 1 pump.

In the embodiment of FIG. 1, the primary rotor 9*a* is a regenerative rotor comprising a disk having a transverse face, e.g. the downstream transverse face in the embodiment shown, that carries a series of concentric annular ribs, each having individual radial blades. In this respect, reference can be made to FIG. 2 which is a perspective view of an embodiment of such a transverse face 9*c* for a regenerative rotor 9*a* of disk shape: there can be seen the successive concentric annular ribs 9*d*, 9*e*, 9*f*, 9*g*, and 9*h*, which extend from the periphery towards the center of the disk. Each concentric annular rib 9*d*–9*h* carries individual radial blades such as the blades 10 which project axially from the top of the corresponding concentric annular rib 9*d*, and each of them is oriented in a direction that is substantially radial relative to the disk forming the regenerative rotor 9*a*.

Figure 4:
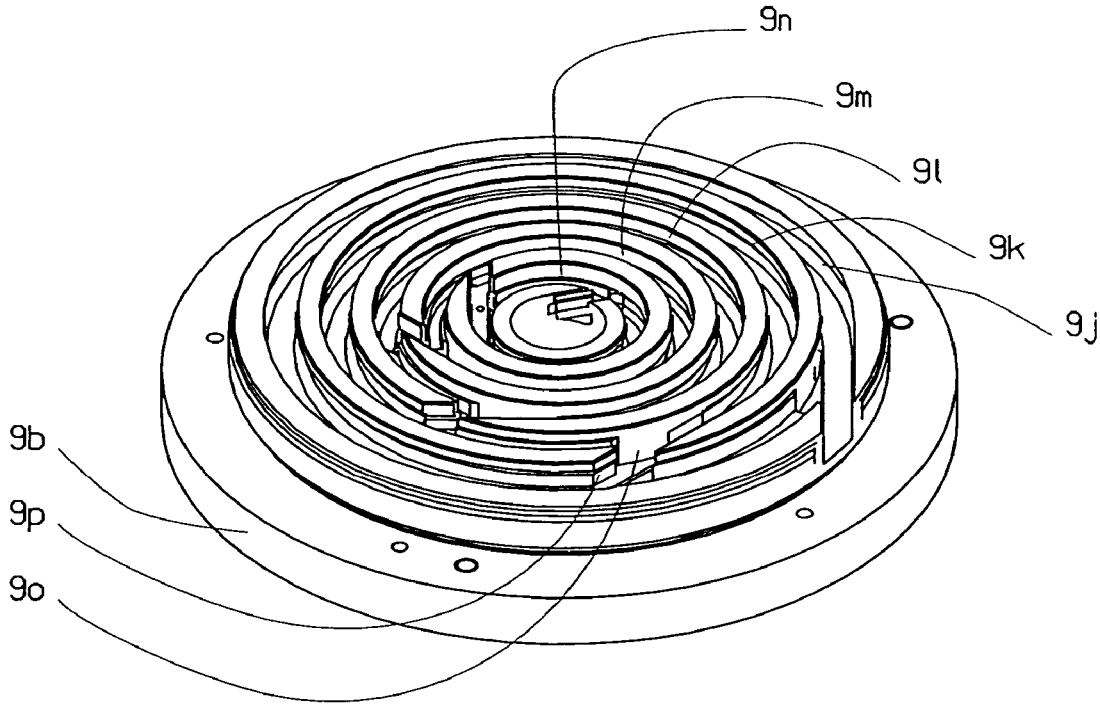
FIG. 4 shows the active upstream transverse face of the regenerative stator of the FIG. 1 pump.

The regenerative stator 9*b* has a transverse wall secured to the pump body 100 and comprising a corresponding transverse face, the upstream transverse face in the embodiment shown, which face has a series of concentric annular grooves. In this respect, reference can be made to FIG. 4 which is a perspective view of an embodiment of such a regenerative stator 9*b*, with concentric annular grooves 9*j*, 9*k*, 9*l*, 9*m*, and 9*n*, corresponding respectively to the respective concentric annular ribs 9*d*–9*h* of the regenerative rotor 9*a*. The individual radial blades such as the blades 10 of the regenerative rotor 9*a* are engaged in the concentric annular grooves 9*j*–9*n*, and to do this the concentric annular grooves 9*j*–9*n* of the regenerative stator 9*b* are of a transverse section that is greater than the corresponding individual radial blades 10 of the regenerative rotor 9*a*, with the exception of a short zone of the groove that is of smaller section and in which the individual radial blades 10 engage with little clearance. Thus, for the groove 9*k* in FIG. 4, there can be seen a small-section groove zone 9*o* in which the groove 9*k* does not flare towards its bottom, unlike the other portions of the same groove.

The successive concentric annular grooves 9*j*–9*n* are connected to one another by communication channels provided at the downstream ends of the corresponding groove zones. Thus, there can be seen the channel 9*p* which connects together the concentric annular grooves 9*j* and 9*k*.

In the embodiment of FIG. 1, there is also shown an additional pump stage 11, at the interface between the primary rotor 9*a* and the upstream portion of the pump body 100. In this case, the second transverse face or upstream transverse face of the regenerative rotor disk 9*a* may be as shown in perspective in FIG. 3 in order to constitute a rotor 11*a* having oblique centrifugal ribs 11*c*, 11*d*, 11*e*, and 11*f* for co-operating with a corresponding transverse face 11*b* (FIG. 1) of the pump body 100 which constitutes a stator.

With reference again to FIG. 1, it can be seen that in the embodiment shown, a plurality of molecular drag pump stages 5 are provided, constituted by rotor elements in the form of concentric cylinders connected to the drive shaft via their upstream ends, i.e. via the transverse wall 5*d*, and stator elements in the form of concentric cylinders having helical ribs connected to the pump body 100 at their upstream ends and engaged between successive concentric cylinders of the rotor. In the figure, there can be seen three stator cylinders and two rotor cylinders engaged between one another.

The figure also shows the turbomolecular pump stage 4 comprising a turbomolecular rotor 4*a* having at least one stage with radial fins, there being two stages with radial fins in the figure, and a turbomolecular stator 4*b* having annular rings, there being two rings in FIG. 1, which engage between the radial fins of the turbomolecular rotor 4*a*. The rings may be fitted parts, stacked axially with suitable spacers, in conventional manner. Alternatively, and also in conventional manner, the stator may be constituted by a peripheral assembly of a plurality of shells fitted radially around the rotor.

In order to reduce the volume of the assembly, it is desirable to use a motor 7 of small size, enabling it to be inserted inside the cavity 5*c* of the molecular drag rotor 5*a*. To do this, it is necessary in particular to improve the cooling of the motor 7, and for this purpose, cooling means 17 can be provided that are engaged in the stator 7*b* of the motor, for example ducts for conveying a cooling fluid.

Alternatively, or additionally, the motor 7 should be adapted to enable a high speed of rotation, greater than 20,000 rpm in nominal operating conditions. The electrical power density is thus greater, thereby enabling the size of the motor to be reduced.

Alternatively or additionally, the concentric annular grooves 9*j*–9*n* and the corresponding individual radial blades 10 are smaller in size in the vicinity of the delivery end of the regenerative stage. In practice, in FIGS. 2 and 4, the transverse size of the grooves and of the blades becomes smaller and smaller on going from the peripheral annular groove 9*j* towards the central annular groove 9*n*, and the same applies to the concentric ribs 9*d*–9*h* and to the individual radial blades 10. As a result, the sets of blades are smaller in the high pressure zone, i.e. in the vicinity of the axis of rotation, thereby reducing viscous friction and enabling the amount of power that the motor needs to develop to be reduced.

Alternatively, or additionally, means are provided for reducing leaks between the regenerative pump stages, by providing very little clearance between the individual radial blades 10 and the small section zones 9*o* of the grooves. This can be obtained by using high-precision machining for the corresponding parts, and can also be obtained by providing means for adjusting the axial position of the regenerative stator 9*b* relative to the regenerative rotor 9*a*, in a manner that is described below.

Figure 5:
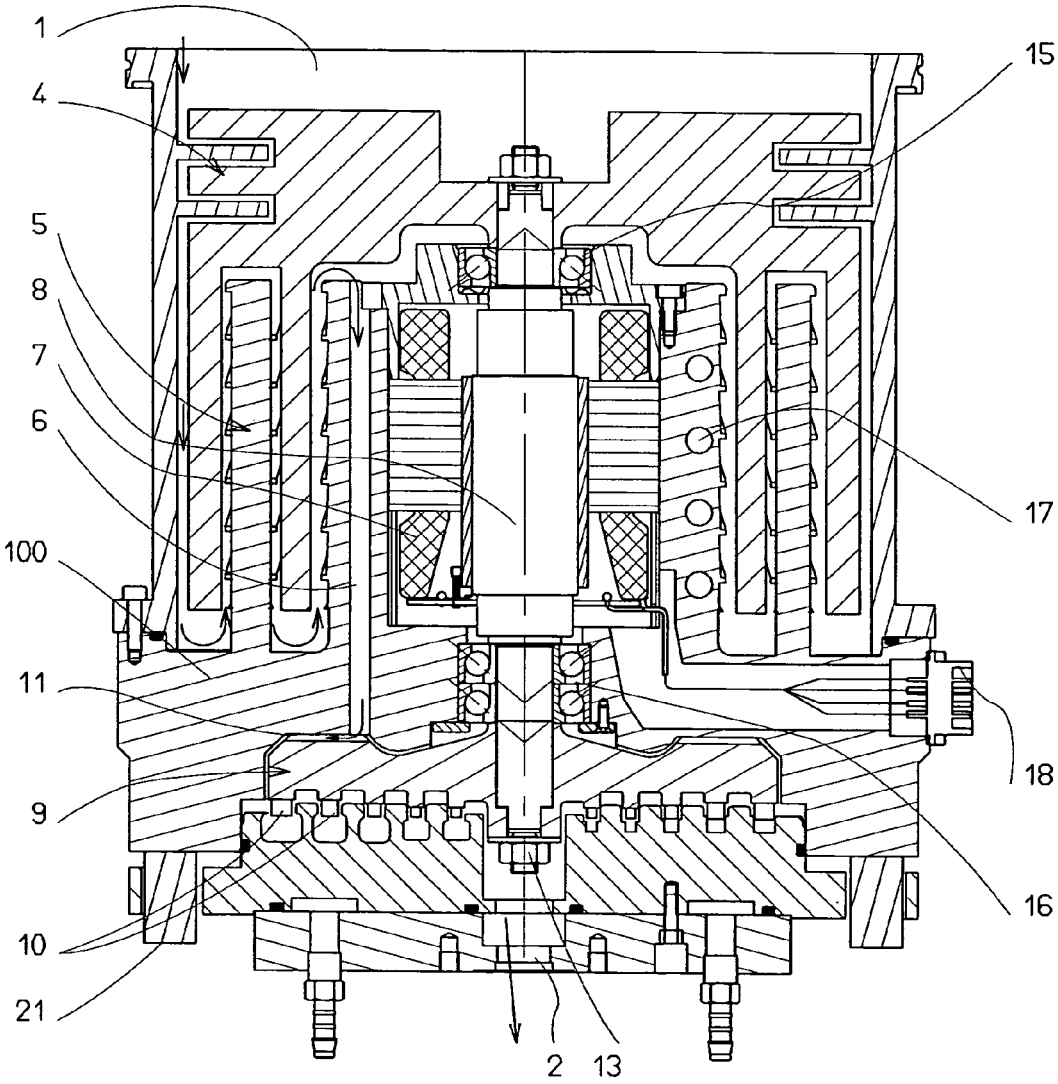
FIG. 5 is a longitudinal section view of the FIG. 1 pump, with the regenerative stator offset.

In the embodiment shown in FIGS. 1 and 5, the regenerative stator 9*b* can be displaced axially between a closest position shown in FIG. 1 and a remotest position shown in FIG. 5. To do this, the regenerative rotor 9*a* can slide axially in the pump body 100 with an annular sealing gasket 100*a* being interposed between them, axial sliding being guided by guide means 21 and the part being driven by displacement means such as an actuator (not shown).

In the closest position shown in FIG. 1, the individual radial blades 10 penetrate to the greatest depth into the corresponding grooves 9*j*–9*n*, thus enabling the clearance between the individual radial blades 10 and the small section zones 9*o* of the grooves to be reduced to the smallest size possible, as shown in FIG. 1 in the right-hand portion of the regenerative rotor 9*a*. In the remotest position as shown in FIG. 5, the clearance between the individual radial blades 10 and the regenerative stator 9*b* is increased, thereby increasing internal leaks, and thus reducing pumping performance.

It is thus possible at will to modify the pumping performance of the regenerative pump, independently of its speed, and in a manner that is fast and efficient by positioning the regenerative stator 9*b* at will in any position between its closest position and its furthest position. Simultaneously, the means for adjusting axial position make it possible to minimize internal leaks when in the closest position as shown in FIG. 1, thus enabling a regenerative pump to be configured having improved performance.

It will be understood that using means for adjusting the position of the regenerative stator 9*b* relative to the regenerative rotor 9*a* is independent of the presence or absence of the other structural portions of the pump shown in FIG. 1, and in particular the presence of the molecular drag and/or turbomolecular stages. These means thus constitute an independent invention which can be used on its own, in certain regenerative pump applications.

Figure 6:
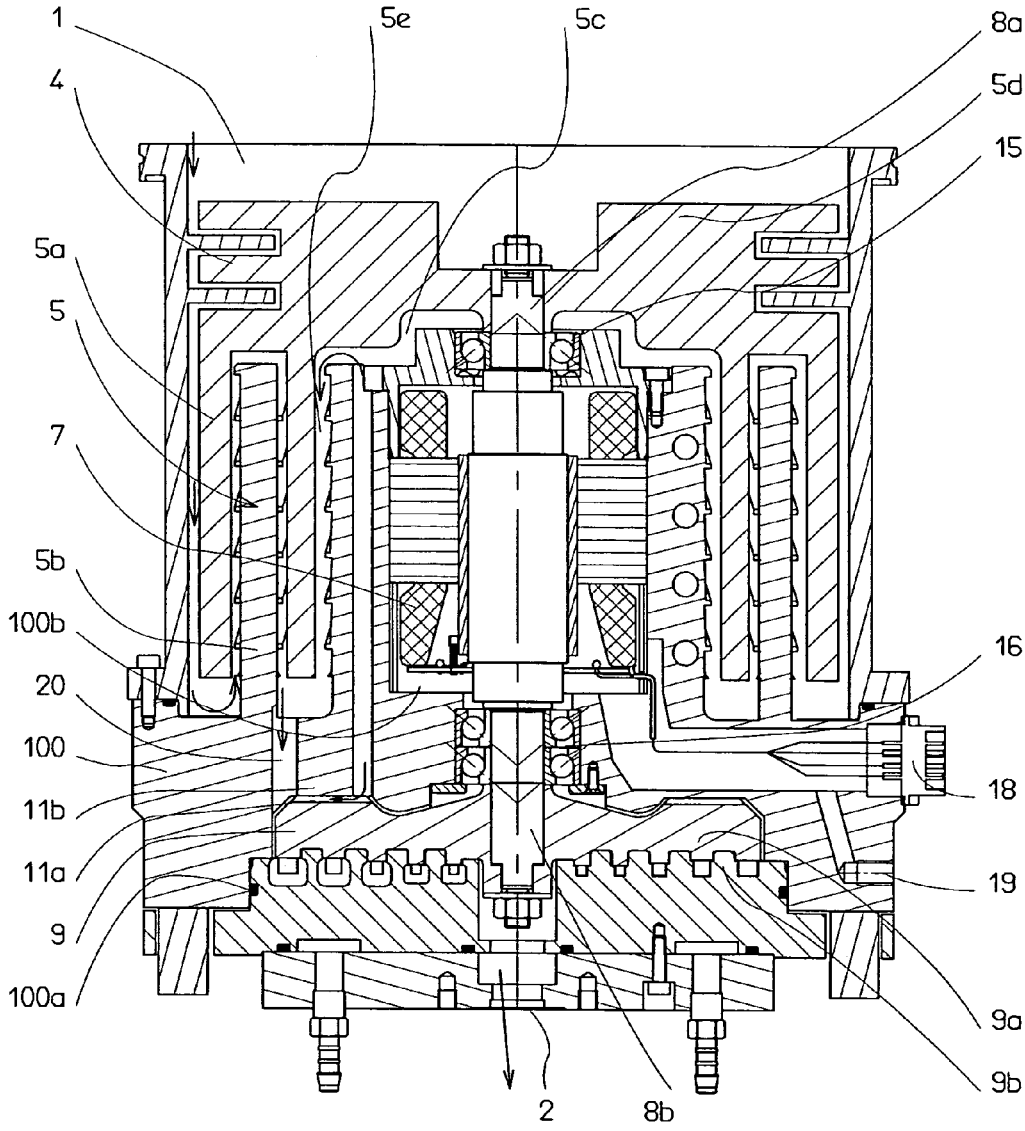
FIG. 6 is a longitudinal section view of a composite vacuum pump in another embodiment of the present invention.

Consideration is given below to the embodiment as shown in FIG. 6. In this embodiment, the composite pump reproduces the same essential means as the embodiment shown in FIG. 1, with the molecular drag pump stages 5 and possibly the turbomolecular pump stages 4, with the regenerative pump stage 9, and with the motor 7 engaged in the posterior cavity 5*c* and mounted on the central segment of the drive shaft 8 whose upstream end 8*a* is coupled to the molecular drag rotor 5*a* and whose downstream zone 8*b* is coupled to the regenerative rotor 9*a*.

In this second embodiment, preference is given to the means for protecting the bearings 15 and 16 against the harmful action of corrosive gases, powders, and dust, which pumps are often required to extract from vacuum chambers. For this purpose, an inlet 19 is provided through which an inert purge gas can be introduced into the housing 100*b* containing the motor 7, and means are provided for sucking the inert gas out through the zones occupied by the bearings 15 and 16.

Thus, a suction duct 20 is provided which goes directly from the delivery of the molecular drag pump stage 5 to the regenerative pump stage 9, at the periphery of the disk forming the regenerative rotor 9*a*, and the direction of the helical grooves in the last stage of the molecular drag pump 5*e* is reversed so that it constitutes an upstream dynamic seal which sucks out the gas coming from the upstream bearing 15 and delivers it to the regenerative pumping stage 9. Simultaneously, provision can be made for the second upstream transverse face 11*a* of the regenerative rotor disk 9*a* to have sloping centrifugal ribs 11*c*–11*f* as shown in FIG. 3 for co-operating with a corresponding face 11*b* of the pump body 100 so as to constitute a downstream dynamic seal which sucks gas from the downstream bearing 16 towards the primary pump stage 9.

The motor 7 is powered by electrical conductors connected to an electrical power connector 18.

In the invention, it is possible to replace the regenerative primary rotor having a downstream transverse face provided with individual radial blades engaged in the concentric annular grooves of a regenerative stator, by any other regenerative multistage primary pump structure that makes use of viscous drag and that operates in satisfactory manner at the speed of rotation of molecular drag pumps or turbomolecular pumps.

Figure 3:
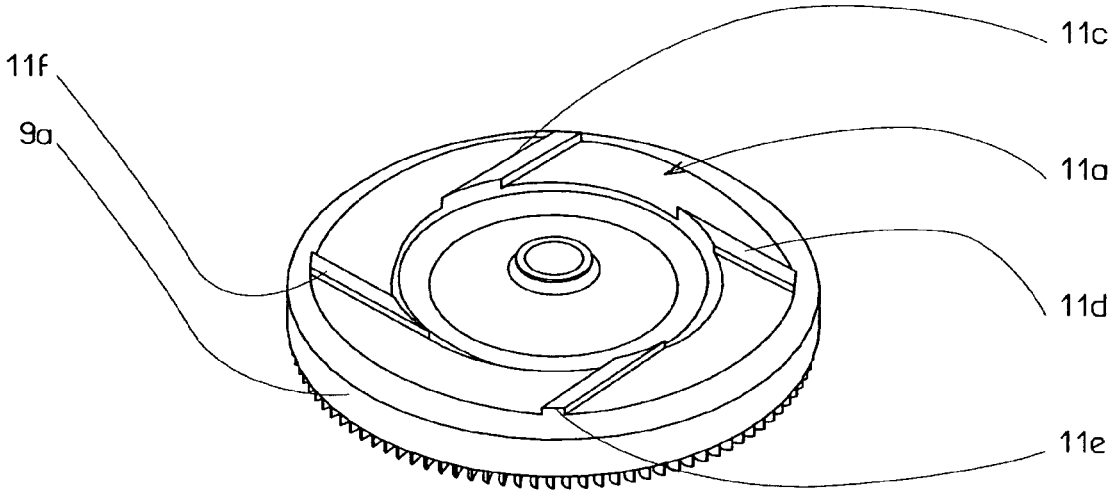
FIG. 3 shows either the upstream transverse face of the regenerative rotor of the FIG. 1 pump in an advantageous embodiment, or the main downstream transverse face of a regenerative rotor in a second embodiment.

A suitable example of another structure that is possible for such a primary stage is shown in FIG. 3. The face 11*a* is then considered as constituting the main face of the rotor 9*a*, and the oblique centrifugal ribs 11*c*–11*f* co-operating with the corresponding transverse face of the stator or pump body constitute a regenerative stage using viscous drag. It is then possible to devise a stack of a plurality of similar disks each having one transverse face carrying oblique centrifugal ribs that co-operate with a corresponding transverse face of a multistage regenerative stator.

This embodiment is also compatible with the presence of an additional regenerative pump stage constituted by the upstream transverse face of the rotor with other oblique centrifugal ribs.

The embodiment is also compatible with a particular disposition of dynamic seals and neutral gas inlets in the zone of the bearings.

In any event, a plurality of molecular drag and/or turbomolecular pump stages can be provided.

The present invention is not limited to the embodiments described above, but includes variants and generalizations that are within the competence of the person skilled in the art.

The invention claimed is:

1. A vacuum pump comprising, in a common pump body (100), at least one molecular drag pump stage (5) in series in air-flow connection with at least one primary pump stage (9) of compatible speed, the molecular drag pump stage (5) having a molecular drag rotor (5*a*) co-operating with a molecular drag stator (5*b*) provided in the pump body (100), the primary pump stage (9) having a primary rotor (9*a*) co-operating with a primary stator (9*b*) provided in the pump body (100), the molecular drag rotor (5*a*) and the primary rotor (9*a*) being rotated by a common drive shaft (8) coupled to a motor (7), the pump being characterized in that:

the molecular drag rotor (5*a*) includes a blind axial cavity (5*c*) that is open towards the downstream end of the pump body (100);

the motor (7) is housed at least in part in said blind axial cavity (5*c*) of the molecular drag rotor (5*a*);

the drive shaft (8) is coupled via its upstream end (8*a*) to the molecular drag rotor (5*a*); and the drive shaft (8) is coupled via its downstream portion (8*b*) to the primary rotor (9*a*); and wherein the primary rotor is a multistage regenerative rotor using viscous drag, comprising a disk comprising a transverse face carrying a series of concentric annular ribs each carrying individual radial blades, and the primary stator is a regenerative stator including a corresponding transverse face comprising a series of concentric annular grooves in which the individual radial blades of the regenerative rotor are engaged.

2. A vacuum pump according to claim 1, in which the drive shaft (8) is carried to rotate by an upstream bearing (15) and a downstream bearing (16), the upstream bearing (15) being situated between the motor (7) and the zone (8*a*) for coupling to the molecular drag rotor (5*a*), the downstream bearing (16) being situated between the motor (7) and the zone (8*b*) for coupling to the primary rotor (9*a*).

3. A vacuum pump according to claim 1, in which:

the concentric annular grooves (9*j*–9*n*) of the regenerative stator (9*b*) are of cross-section that is greater than the cross-section of the corresponding individual radial blades (10) of the regenerative rotor (9*a*), with the exception of a short groove zone (9*o*) of small section in which the individual radial blades (10) engaged with little clearance; and the successive concentric annular grooves (9*j*–9*n*) are connected to one another via respective communication channel (9*p*) provided at the downstream end of the corresponding small section groove zone (9*o*).

4. A vacuum pump according to claim 3, in which the primary rotor (9*a*) includes an upstream transverse face (11*a*) having oblique centrifugal ribs (11*c*–11*f*) which co-operate with a corresponding transverse face (11*b*) of the pump body (100) in order to constitute an additional regenerative pump stage (11).

5. A vacuum pump according to claim 1, in which the primary rotor (9*a*) has an upstream transverse face (11*a*) with oblique centrifugal ribs (11*c*–11*f*) which co-operate with a corresponding transverse face (11*b*) of the pump body (100) to constitute an additional regenerative pump stage (11).

6. A vacuum pump according to claim 1, comprising a plurality of molecular drag pump stages (5) constituted by rotor elements in the form of concentric cylinders connected to the drive shaft (8) at their upstream ends, and a plurality of stator elements in the form of concentric cylinders having helical ribs and connected to the pump body (100) at their downstream end, and engaged between successive concentric rotor cylinders.

7. A vacuum pump according to claim 1, further comprising at least one turbomolecular pump stage (4) in gas-flow connection upstream from the at least one molecular drag pump stage (5), the turbomolecular pump stage (4) comprising a turbomolecular rotor (4*a*) having at least one stage with radial fins and a turbomolecular stator (4*b*) having at least one annular groove in which the radial fins of the turbomolecular rotor (4*a*) are engaged.

8. A vacuum pump according to claim 7, comprising a plurality of turbomolecular stages constituted by a rotor having a plurality of stages of radial fins distributed along the drive shaft (8) and a plurality of corresponding annular grooves distributed along the stator (4*b*).

9. A vacuum pump according to claim 1, in which the drive shaft (8) is guided in rotation by magnetic bearings (15, 16).

10. A vacuum pump comprising, in a common pump body, at least one molecular drag pump stage in series in air-flow connection with at least one primary pump stage of compatible speed, the molecular drag pump stage having a molecular drag rotor co-operating with a molecular drag stator provided in the pump body, the primary pump stage having a primary rotor co-operating with a primary stator provided in the pump body, the molecular drag rotor and the primary rotor being rotated by a common drive shaft coupled to a motor, the pump being characterized in that:

the molecular drag rotor includes a blind axial cavity that is open towards the downstream end of the pump body;

the motor is housed at least in part in said blind axial cavity of the molecular drag rotor;

the drive shaft is coupled via its upstream end to the molecular drag rotor; and the drive shaft is coupled via its downstream portion to the primary rotor; and in which the primary rotor (9*a*) is a multistage regenerative rotor using viscous drag comprising one or more disks, each having a transverse face carrying oblique centrifugal ribs which co-operate with a corresponding transverse face of a multistage regenerative stator.

11. A vacuum pump according to claim 10, in which the primary pump stage (9) wherein:

the oblique centrifugal ribs (11*c*–11*f*) of the rotor co-operate with the corresponding transverse face (11*b*) of the pump body (100) to constitute a downstream dynamic seal which produces suction protecting the downstream bearing (16);

a last molecular drag stage is reversed to constitute an upstream dynamic seal which produces suction protecting the upstream bearing (15); and an inert gas inlet (19) is adapted to deliver a flow of inert gas into the housing (100*b*) containing the motor (7), thereby producing a flow of inert gas through the bearings (15, 16).

12. A vacuum pump comprising, in a common pump body, at least one molecular drag pump stage in series in air-flow connection with at least one primary pump stage of compatible speed, the molecular drag pump stage having a molecular drag rotor co-operating with a molecular drag stator provided in the pump body, the primary pump stage having a primary rotor co-operating with a primary stator provided in the pump body, the molecular drag rotor and the primary rotor being rotated by a common drive shaft coupled to a motor, the pump being characterized in that:

the molecular drag rotor includes a blind axial cavity that is open towards the downstream end of the pump body;

the motor is housed at least in part in said blind axial cavity of the molecular drag rotor;

the drive shaft is coupled via its upstream end to the molecular drag rotor; and the drive shaft is coupled via its downstream portion to the primary rotor; and in which the motor (7) includes cooling means (17) engaged in the stator (7*b*) of the motor.

13. A vacuum pump comprising, in a common pump body, at least one molecular drag pump stage in series in air-flow connection with at least one primary pump stage of compatible speed, the molecular drag pump stage having a molecular drag rotor co-operating with a molecular drag stator provided in the pump body, the primary pump stage having a primary rotor co-operating with a primary stator provided in the pump body, the molecular drag rotor and the primary rotor being rotated by a common drive shaft coupled to a motor, the pump being characterized in that:

the molecular drag rotor includes a blind axial cavity that is open towards the downstream end of the pump body;

the motor is housed at least in part in said blind axial cavity of the molecular drag rotor;

the drive shaft is coupled via its upstream end to the molecular drag rotor; and the drive shaft is coupled via its downstream portion to the primary rotor; and in which:

the motor (7) is adapted for a high speed of rotation, greater than 20,000 rpm in nominal operating conditions; and the concentric annular grooves (9*j*–9*n*) and the corresponding individual radial blades (10) are of a size that is smaller in the vicinity of the delivery from the primary pump stage (9).

14. A vacuum pump comprising, in a common pump body, at least one molecular drag pump stage in series in air-flow connection with at least one primary pump stage of compatible speed, the molecular drag pump stage having a molecular drag rotor co-operating with a molecular drag stator provided in the pump body, the primary pump stage having a primary rotor co-operating with a primary stator provided in the pump body, the molecular drag rotor and the primary rotor being rotated by a common drive shaft coupled to a motor, the pump being characterized in that:

the molecular drag rotor includes a blind axial cavity that is open towards the downstream end of the pump body;

the motor is housed at least in part in said blind axial cavity of the molecular drag rotor;

the drive shaft is coupled via its upstream end to the molecular drag rotor; and the drive shaft is coupled via its downstream portion to the primary rotor; and in which the primary stage (9*b*) is mounted to be movable in the axial direction relative to the pump body (100) and is driven by displacement means enabling its axial position relative to the primary rotor (9*a*) to be modified, thereby enabling pumping performance to be adjusted.

15. A vacuum pump comprising, a pump body;

a molecular drag pump stage, comprising a molecular drag rotor co-operating with a molecular drag stator provided in the pump body;

a primary pump stage in series communication with the molecular drag pump stage, the primary pump stage comprising a primary rotor co-operating with a primary stator provided in the pump body; and a motor comprising a common drive shaft that rotates the molecular drag rotor and the primary rotor; and wherein the molecular drag rotor comprises a blind axial cavity opened towards a downstream end of the pump body;

wherein the motor is housed at least in part in the blind axial cavity; and wherein the primary rotor is a regenerative rotor, comprising a disk comprising a series of concentrically and annularly arranged individual radial blades, and the primary stator is a regenerative stator comprising a corresponding series of concentric annular grooves in which the individual radial blades are engaged.

16. The vacuum pump according to claim 15, wherein the drive shaft is coupled via an upstream portion of the drive shaft to the molecular drag rotor; and the drive shaft is coupled via a downstream portion of the drive shaft to the primary rotor.

17. The vacuum pump according to claim 15, wherein the primary rotor comprises an upstream face with oblique centrifugal ribs that co-operate with an opposing face of the pump body.

18. The vacuum pump according to claim 15, further comprising a turbomolecular pump stage upstream from the molecular drag pump stage, the turbomolecular pump stage comprising a turbomolecular rotor comprising at least one stage with radial fins and a turbomolecular stator comprising at least one annular groove in which the radial fins of the turbomolecular rotor are engaged.

19. The vacuum pump according to claim 15, wherein the motor comprises a motor stator and cooling means for cooling the motor, the cooling means engaged in the motor stator.

20. The vacuum pump according to claim 15, wherein the motor is adapted for high speed of rotation greater than 20,000 rpm in nominal operating conditions, the concentric annular grooves and the corresponding individual radial blades are of a size that is smaller in the vicinity of the delivery from the primary pump stage.

21. The vacuum pump according to claim 15, wherein the primary stator is mounted for movement in an axial direction relative to the pump body, the movement driven by displacement means for enabling an axial position of the primary stator relative to the primary rotor to be modified, thereby enabling pumping performance to be adjusted.

22. A vacuum pump comprising, a pump body;

a molecular drag pump stage, comprising a molecular drag rotor co-operating with a molecular drag stator provided in the pump body;

a primary pump stage in series communication with the molecular drag pump stage, the primary pump stage comprising a primary rotor co-operating with a primary stator provided in the pump body; and a motor comprising a common drive shaft that rotates the molecular drag rotor and the primary rotor; and wherein the molecular drag rotor comprising a blind axial cavity opened towards a downstream end of the pump body;

wherein the motor is housed at least in part in the blind axial cavity; and wherein the primary rotor is a rotor using viscous drag comprising a disk having a transverse face with oblique centrifugal ribs that co-operate with a corresponding transverse face of a stator.

* * * * *